US006638133B1

(12) United States Patent
Brancolino et al.

(10) Patent No.: US 6,638,133 B1
(45) Date of Patent: Oct. 28, 2003

(54) LADY'S HAIR ACCESSORY DOLL

(76) Inventors: Ronnie Lynn Brancolino, 4941 Newport Cove Dr., #A, Las Vegas, NV (US) 89119; Josephine Koumbis, 8038 Orchestra Ave., Las Vegas, NV (US) 89123

( * ) Notice: Subject to any disclaimer, the term of this patent is extended or adjusted under 35 U.S.C. 154(b) by 5 days.

(21) Appl. No.: 10/120,247

(22) Filed: Apr. 11, 2002

(51) Int. Cl.[7] ..... A63H 3/00

(52) U.S. Cl. ..... 446/73; 446/71; 446/385; 206/457; 132/275

(58) Field of Search ..... 446/319, 72, 73, 446/71, 379, 320, 372, 385; 132/273, 275; 206/457, 575, 581

(56) References Cited

U.S. PATENT DOCUMENTS 1,333,118 A * 3/1920 Klinker ..... 446/72
1,612,805 A * 1/1927 Fracnke ..... 446/385
1,880,944 A * 10/1932 Estes ..... 206/457
2,249,335 A * 7/1941 Turner ..... 446/385
5,626,503 A * 5/1997 Heftel et al. ..... 446/73

* cited by examiner

*Primary Examiner*—Derris H. Banks
*Assistant Examiner*—Bena B. Miller
(74) *Attorney, Agent, or Firm*—Leonard Weiss

(57) ABSTRACT

In a first embodiment, a hair accessory doll is made from a mop that has a pliable plastic loop about its center. The mop is folded about an edge of the loop, thereby providing a demarcation between the loop with a first group of mop strands and a second group of mop strands. A bend of the first group is made to bring sides thereof into contact with each other. The bend is maintained by a cloth mask that is sewn about the first group. In a second embodiment, a head of a doll is a polystyrene ovoid. A rope with a hollow center has a center section that extends over the head. A wire loop is inserted in an end section of the rope, thereby forming a bendable appendage from which jewelry and hair accessories are hung.

33 Claims, 5 Drawing Sheets

LADY'S HAIR ACCESSORY DOLL

BACKGROUND OF THE INVENTION

1. Field of Invention

This invention relates generally to devices for storing a lady's accessories and more particularly to a doll for storing accessories such as combs, hair clips, barrettes and jewelry.

2. Description of the Prior Art

A lady's accessories are typically of varying shapes and sizes that makes them difficult to organize. Accordingly, the accessories are most often loosely stored in a drawer which may make a selection of a particular hair clip, for example, a difficult and lengthy process. Additionally, the loose storage of the accessories may cause them to become entangled and damaged.

As an alternative to disorganized storage, the accessories may be placed at a location where they are all in plain view. The same difficulties in organizing would also ordinarily prevent the accessories in plain view from being an attractive sight. Additionally, an undesireably large space may be needed to place the accessories in plain view.

Accordingly, there is a need for a way of placing the accessories in plain view in a convenient and attractive manner that is spatially compact.

SUMMARY OF THE INVENTION

According to a first aspect the present invention, a mop has a pliable plastic loop about its center. The mop is folded about the loop, thereby providing a demarcation between a first group of mop strands and a second group of mop strands. There is a bend in the first group that brings its sides into contact. The bend is maintained by a mask that is sewn about the first group.

According to a second aspect of the present invention, a center section of a length of rope with a hollow center extends over the head of a doll. A wire is within the hollow center of an end section of the rope.

Other objects, features, and advantages of the invention should be apparent from the following description of the preferred embodiment thereof as illustrated in the accompanying drawing.

DESCRIPTION OF THE EMBODIMENTS

Figure 1:
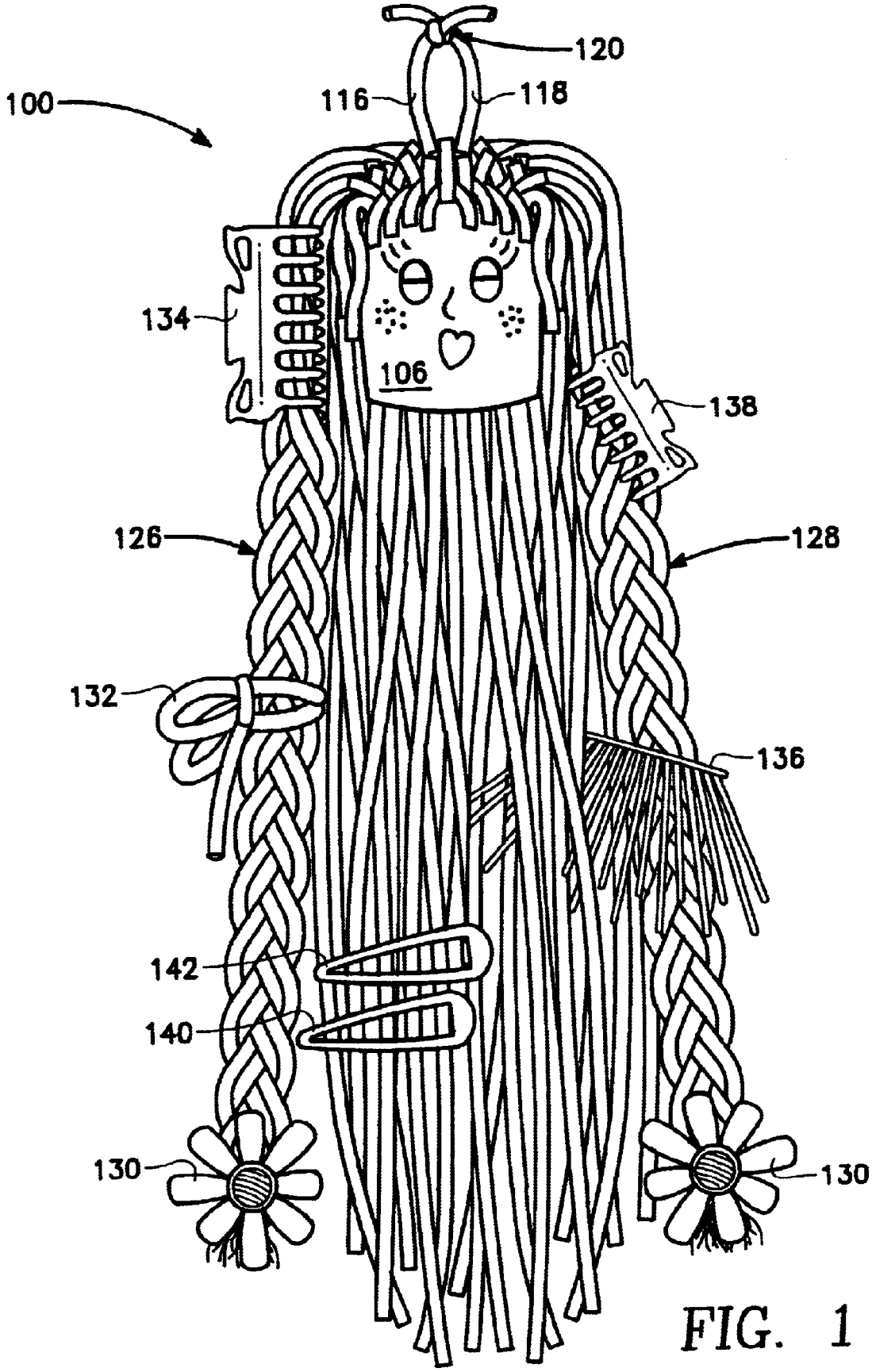
FIG. 1 is a front elevation of a hair accessory doll in accordance with a first embodiment of the present invention.
Figure 2:
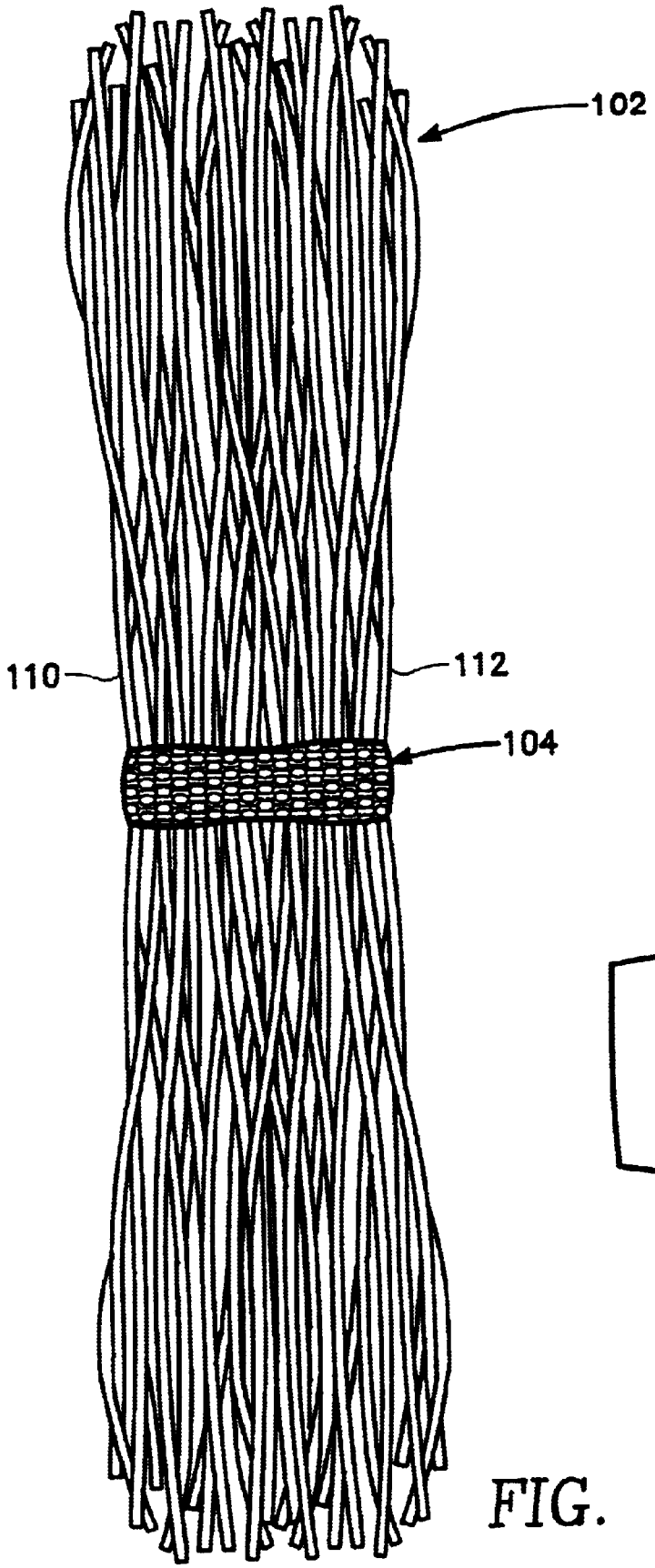
FIG. 2 is a plan view of a mop that is used to construct the doll of FIG. 1.
Figure 3:
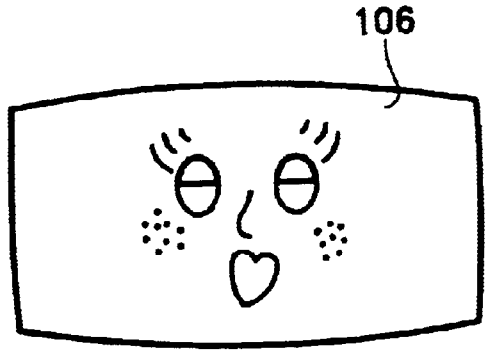
FIG. 3 is a plan view of a mask.

As shown in FIGS. 1–3, a hair accessory doll 100 (FIG. 1) of a first embodiment of the invention includes a mop 102 (FIG. 2) of a type that is commonly used to clean a floor. The mop 102 is comprised of a multiplicity of generally parallel fiber strands with a pliable plastic loop 104 about their center. The doll 100 additionally includes a cloth mask 106 (FIG. 3) that has an imprint of a face thereon.

As shown in FIGS. 2–6, an assembly 108 (FIG. 4) is formed by folding the mop 102 about an edge 109 of the loop 104 (FIG. 6) thereby providing a demarcation between the loop 104 with a first group of mop strands 111A and a second group of mop strands 111B. Thereafter, a bend of the first group is made to bring sides 110, 112 (FIG. 5) thereof into contact with each other. The bend is maintained by sewing the mask 106 about the loop 104 and the first group 111A.

Figure 4:
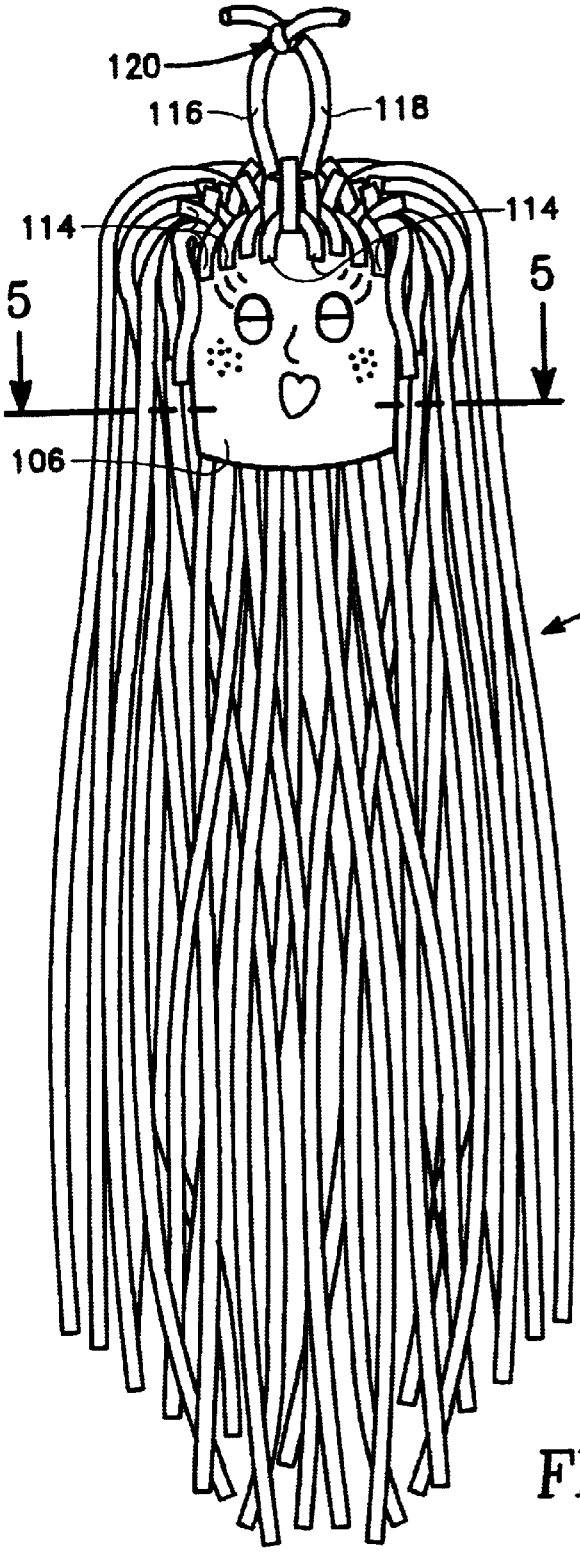
FIG. 4 is plan view of an assembly that includes the mop of FIG. 2 and the mask of FIG. 3.
Figure 5:
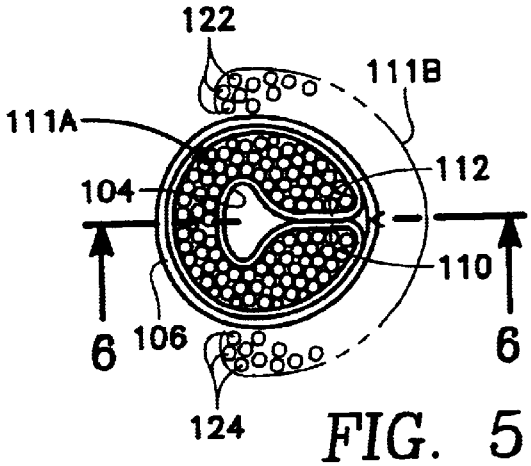
FIG. 5 is a view of a section of the assembly of FIG. 4 taken along the line 5—5 and rotated ninety degrees in a clockwise direction.
Figure 6:
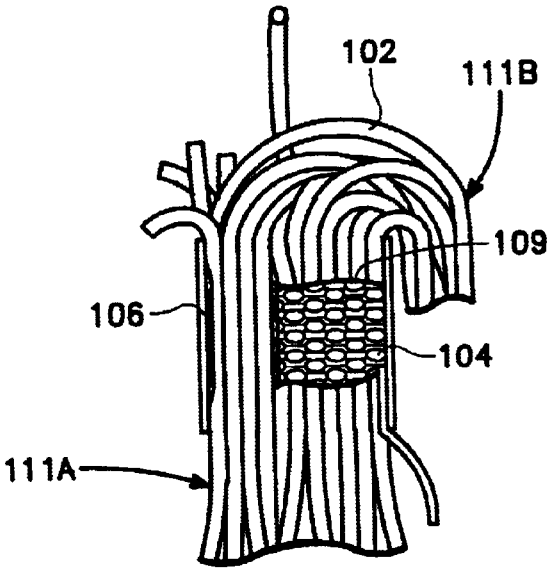
FIG. 6 is a view of a section of FIG. 5 taken along the line 6—6.

Most of the strands of the second group 111B are made to fall in a direction that does not occlude the mask 106. However, strands 114 of the second group 111B pass over the mask 106 and are cut to provide a hair styling known as bangs (FIG. 4). Additionally, strands 116, 118 of the second group 111B are shortened and tied together to form a tether 120 from which the doll 100 may be suspended.

The doll 100 is made from the assembly 108 by braiding strands 122, 124 (FIG. 5) of the second group 111B to make braids 126, 128 (FIG. 1), respectively. A decorative applique 130 in the shape of a daisy may be connected to an end of each of the braids 126, 128. In this embodiment, a decorative bow 132 made from a strand of the mop 102 is fastened to the braid 126.

Exemplary of the use of the doll 100, a hair clip 134 is 19 connected to the braid 126. A comb 136 and a hair clip 138 is connected to the braid 128. Barrettes 140, 142 are connected to strands of the doll 100.

Figure 7:
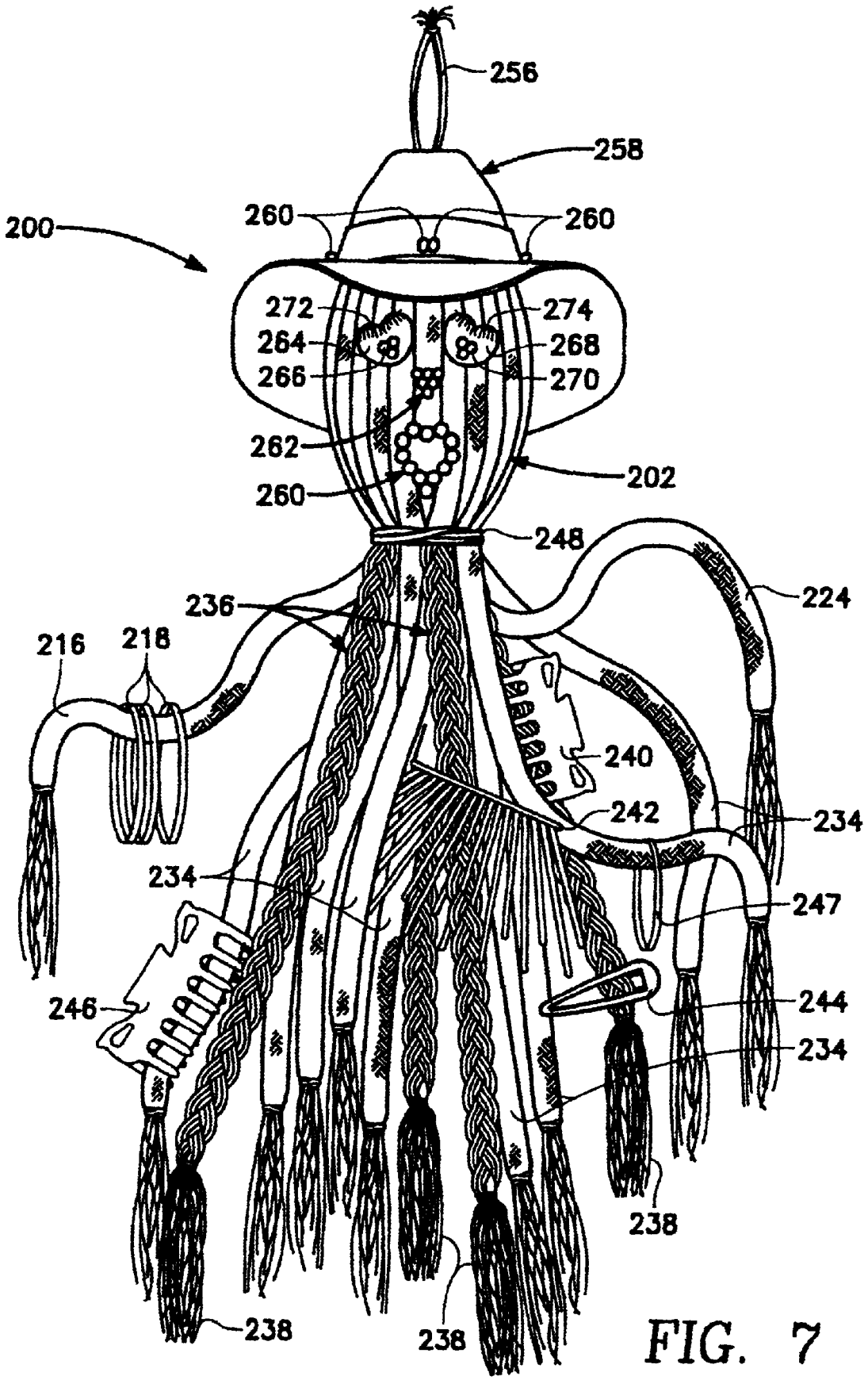
FIG. 7 is a front elevation of a hair accessory doll in accordance with a second embodiment of the present invention.
Figure 8:
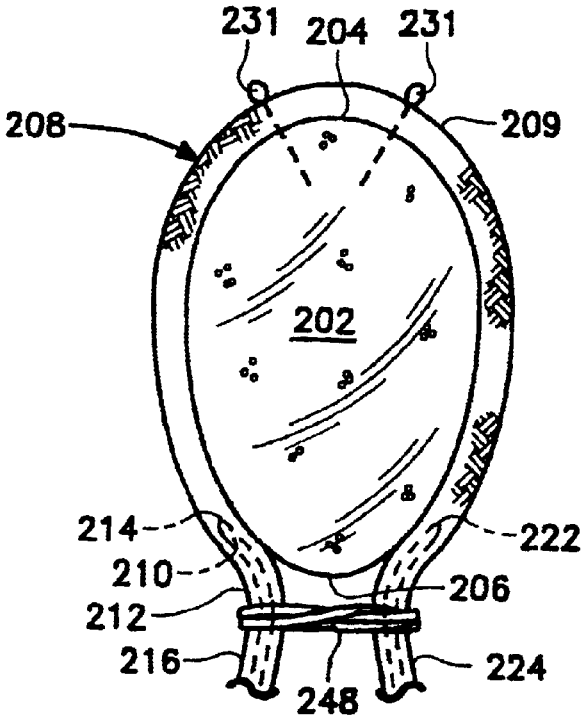
FIG. 8 is a front view of an ovoid used to construct a head of the doll of FIG. 7.

As shown in FIGS. 7 and 8, in a second embodiment of the invention, a doll 200 (FIG. 7.) has a head 202 (FIG. 8) which is an ovoid made from polystyrene. The head 202 has a crown 204 and a bottom part 206. Ovoids made from polystyrene are commonly available in hobby shops.

Exemplary of a feature of the doll 200, a twelve strand length of hobbyists rope 208 has a center section 209 that extends over the crown 204 and along the head 202 towards the bottom part 206. As explained hereinafter, end sections of the rope 208 form appendages of the doll 200 from which hair accessories and jewelry are hung.

When purchased, the twelve strand rope has a plastic core. The plastic core is removed, thereby causing the rope 208 to be hollow. Typically, some of the twelve strands are red and some are white, with the red and white strands combined to form a decorative design.

Figure 9:
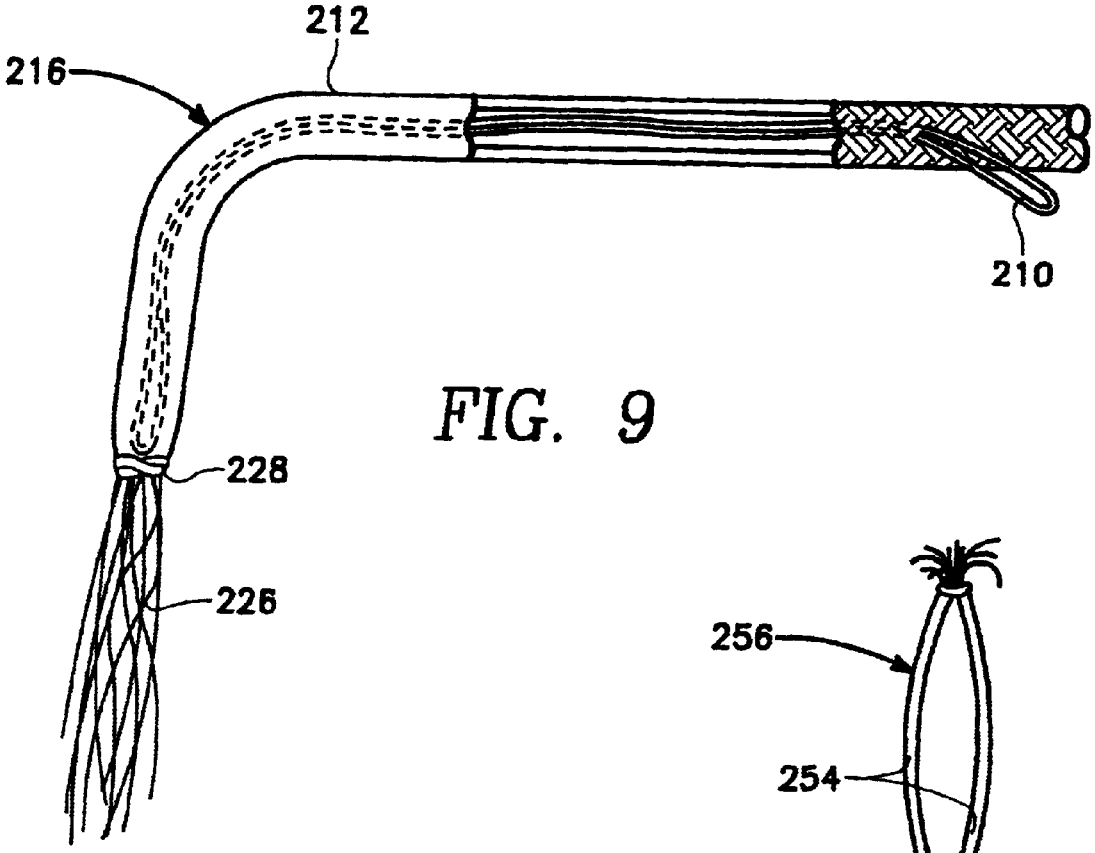
FIG. 9 is a side elevation of one end of a hollowed rope wherein a wire loop is partially inserted, the rope being of a type that is used to make the doll of FIG. 7.

As shown in FIG. 9, a wire loop 210, preferably made from 18 gauge copper wire, is partially inserted within an end section 212 of the rope 208. The wire loop 210 extends from a location 214 (FIG. 8). The partial insertion is shown only for illustrative purposes.

In this embodiment, the wire loop 210 is completely inserted within the section 212. The section 212 with the wire loop 210 therein forms an appendage 216 (FIG. 7) of the doll 200 that may be bent in a manner that makes it suitable, for example, for hanging bracelets 218 therefrom. In a manner similar to that described hereinbefore, the rope 208 has an end section (FIG. 8) wherein a wire loop 222 is inserted to form a bendable arm 224 (FIG. 7).

The section 212 is unraveled at an end 226 (FIG. 9) thereof for decorative purposes. The end 226 includes a tie, such as a colored rubber band 228 or any other fastener, that prevents undesired unraveling. Alternatively, a silk cord is used for the tie. In a similar manner, the section 220 is unraveled at an end and prevented from undesired unraveling.

Figure 10:
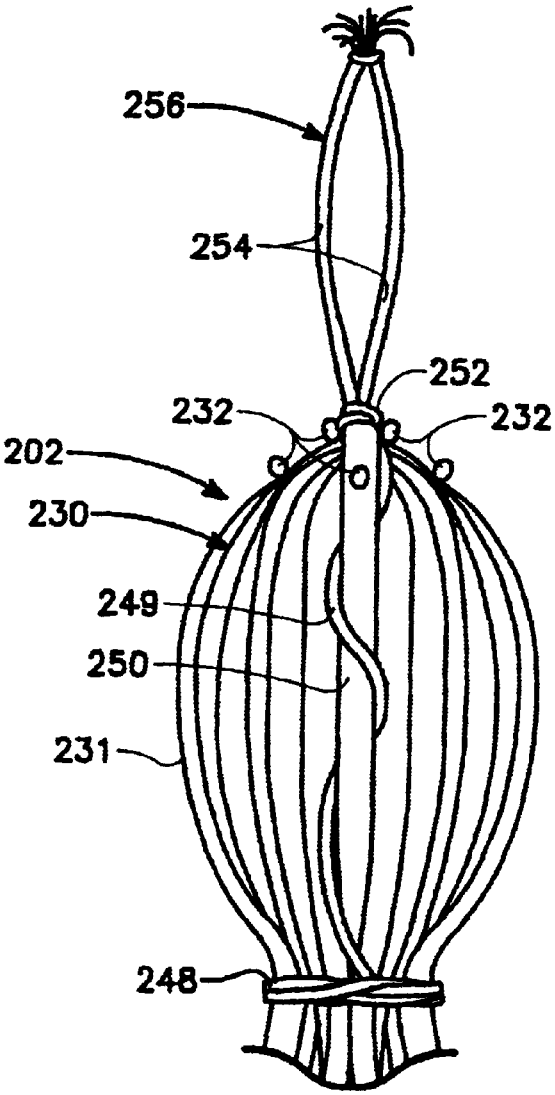
FIG. 10 is a rear view of the head of the doll of FIG. 7.

As shown in FIG. 10, the rope 208 is included in a plurality of lengths of rope 230 that have center sections 231 that extend over the crown 204 and along the head 202 towards the bottom 206. The center sections 231 are maintained on the crown 204 by imitation pearl headed pins 232 that pass through some of the center sections 231 into the head 202. Alternatively, either glue (not shown) or any suitable adhesive are used to maintain the center sections 231 on the crown 204.

Some of the lengths of rope 230 have end sections that are made to form a plurality bendable arms 234 (FIG. 7) similar to the arms 216, 224. Others of the ropes 230 have end sections that are unraveled and made into appendages in the form of braids 236. The braids 236 have ends 238 similar to the end 216 described hereinbefore.

Exemplary of the use of the doll 200, a hair clip 240, a comb 242 and a barrette 244 are connected to the braids 234. A hair clip 246 and a bracelet 247 are connected to the end sections 232.

A silk neck cord 248 (FIGS. 7, 8 and 10) is fastened about the sections 208, 230, near the end 206 (FIGS. 8 and 10). A silk back cord 249 is tied to the cord 248 and routed around a length of rope 250 (FIG. 10) of the ropes 230 and tied near the crown 204 to form a bundle 252. A silk cord 254 passes through the bundle 252. Ends of the cord 254 are tied together, thereby forming a tether loop 256.

A hat 258 (FIG. 7) is maintained upon the sections 231 by pins 260 that are similar to the pins 232. Alternatively, the hat 258 is maintained by an adhesive such as glue. The tether loop 256 passes through a slit (not shown) in the hat 258. The tether loop 256 is typically used to hang the doll 200 from a hook.

A plurality of pins 260, similar to the pins 232, pass through some of the sections 231 into the head 202 at mouth positions that cause heads of the pins 260 to provide an outline of a mouth of the doll 200 in the general shape of a heart. In one alternative embodiment, the mouth is a piece of cloth in the general shape of a heart is either glued or sewn onto the sections 231 at a mouth position. In another alternative embodiment, the mouth is either a paint or a substance known as puff paint that is applied to the sections 231. Puff paint is available from hobby shops.

A plurality of pins 262, similar to the pins 232, pass through some of the sections 231 into the head 202 at nose positions that cause heads of the pins 262 to provide a nose of the doll 200. In one alternative embodiment, the nose is a piece of cloth that is either sewn or glued onto the sections 231 at a nose position. In another alternative embodiment, the nose is made from either the paint or the puff paint.

A right eye of the doll 200 is a heart shaped piece of cloth 264 maintained upon the head 202 by a plurality of pins 266, similar to the pins 232, that pass through some of the sections 231 into the head 202 at right eye positions. A pupil of the right eye is formed by heads of the pins 266.

Correspondingly, a left eye of the doll 200 is a heart shaped piece of cloth 268 maintained upon the head 202 by a plurality of pins 270, similar to the pins 232, that pass through some of the sections 231 into the head 202 at left eye positions. A pupil of the left eye is formed by heads of the pins 270.

In one alternative embodiment, the pieces of cloth 264, 268 are maintained by an adhesive, such as glue and the pupils are formed by connecting a piece of cloth to each of the pieces of cloth 264, 268 by the adhesive. Alternatively, the eyes are puff paint applied to the lengths of rope 231 at the eye positions.

False eyelashes 272, 274 are sewn onto the cloths 264, 268, respectively, thereby providing eyelashes for the doll 200. False eyelashes are commonly available in hobby shops. In an alternative embodiment, the false eyelashes are made from cloth and either sewn or glued onto the cloths 264, 268.

While the invention has been particularly shown and described with reference to two embodiments thereof, it should be understood by those skilled in the art that changes in form and detail may be made therein without departing from the spirit and scope of the invention.

We claim:

1. A hair accessory doll comprising:

a mop having strands that pass through a pliable plastic loop which is substantially about the center of the strands, said strands being folded proximal to said loop, thereby providing a demarcation between said loop with a first group of strands and a second group of strands; and a mask around said first group that maintains a bend that brings sides of said first group into contact.

2. The doll of claim 1 wherein said mask is made from cloth with a likeness of a face thereon.

3. The doll of claim 1 wherein some strands of said first group are braided.

4. The doll of claim 1 wherein said mask is sewn around said first group and said loop.

5. A hair accessory doll, comprising:

an ovoid that forms a head with a crown and a bottom part;

a multiplicity of hollow lengths of ropes, each with a center section that extends over said crown and along said head to substantially said bottom part to substantially cover said head therebetween, said lengths of rope each having a pair of end sections that extend from opposite ends of each center section; and a neck cord tied about said end sections proximal to said bottom part.

6. The doll of claim 5 additionally comprising a wire disposed within at least one of said end sections.

7. The doll of claim 5 additionally comprising means for maintaining said center sections over said crown and along said head.

8. The doll of claim 7 wherein said means comprises a pearl headed pin.

9. The doll of claim 5 additionally comprising:

a hat: and means for maintaining said hat on said center section.

10. The doll of claim 8 wherein said means is a pin that passes through said hat and a center section into said head.

11. The doll of claim 5 where said wire is a loop of 18 gauge wire, said one end section with said wire loop therein forming a bendable appendage.

12. The doll of claim 5 wherein said wire is in an end section that has an end unravelled for decorative purposes.

13. The doll of claim 12 additionally comprising a tie around said end that prevents an undesired unraveling.

14. The doll of claim 5 wherein at least one of said end sections is unravelled and made into a braid.

15. The doll of claim 14 additionally comprising a tie at an end of said braid.

16. The doll of claim 5 wherein said ovoid is made of polystyrene.

17. The doll of claim 5 wherein said neck cord is made of silk.

18. The doll of claim 5 additionally comprising:

a back cord tied to said neck cord, routed to said crown and forming a bundle thereat; and a tether cord having ends that are tied to said bundle.

19. The doll of claim 5 additionally comprising means for providing a mouth of said doll.

20. The doll of claim 19 wherein said means comprises a plurality of pins having white pearl-like heads, said pins passing through center sections into said head at mouth positions that cause said white pin heads to provide an outline of said mouth in the general shape of a heart.

21. The doll of claim 5 additionally comprising means for providing a nose of said doll.

22. The doll of claim 21 wherein said means comprises a group of pins having black pearl-like heads, said pins passing through center sections into said head at nose positions that cause said pin heads to provide an outline of said nose in the general shape of a heart.

23. The doll of claim 5 comprising means for providing two eyes of said doll.

24. The doll of claim 23 wherein said means comprises;

a first and a second piece of cloth in the general shape of a heart, said first and second cloths being disposed at right and left eye locations, respectively, of said doll;

a first group of rounded white headed pins that pass through said first cloth, through at least one of said center sections and into said head to maintain the disposition of said first cloth, heads thereof being a pupil of said right eye;

a second group of rounded white headed pins that pass through said second cloth, through at least one of said center sections and into said head to maintain the disposition of said second cloth, heads thereof being a pupil of said left eye; and first and second false eye lashes that are connected to said first and second pieces of cloth, respectively.

25. In the method of making a hair accessory doll, comprising the steps of:

providing a pliable loop about the center of strands of a mop;

folding said mop proximal to an edge of said loop, thereby providing a demarcation between said loop with a first group of said mop strands and a second group of said mop strands;

bending of said first group to bring sides thereof into contact with each other; and maintaining said bend with a mask sewn about said first group.

26. The method of claim 25, including the additional step of providing an image of a face on said mask.

27. The method of claim 25, including the additional step of braiding some strands of said first group.

28. In the method of making a hair accessory doll, comprising the steps of:

providing a head of said doll in the shape of an ovoid, said head having a crown and a bottom part;

providing a multiplicity of hollow ropes that each have a center section with ends that are each connected to an end section;

extending said center sections over said crown and along said head to substantially said bottom part;

positioning said center sections to substantially cover said head between said crown and said bottom part; and tieing a cord about said end sections proximal to said bottom part.

29. The method of claim 28 comprising the additional step of placing a wire within at least one of said end sections.

30. The method of claim 28 comprising the additional step of forming said wire into a loop.

31. The method of claim 28 comprising the additional step of preventing undesired unraveling of said end sections.

32. The method of claim 28 comprising the additional steps of:

unravelling at least one of said end sections; and making a braid from said unravelled end section.

33. The method of claim 32 comprising the additional step of providing a tie at an end of said braid.

* * * * *